United States Patent [19]

Sartori

[11] Patent Number: 4,804,447

[45] Date of Patent: Feb. 14, 1989

[54] METHOD OF PRODUCING $NF_3$

[75] Inventor: Peter Sartori, Duisburg, Fed. Rep. of Germany

[73] Assignee: Kali-Chemie Aktiengesellschaft, Hanover, Fed. Rep. of Germany

[21] Appl. No.: 212,665

[22] Filed: Jun. 28, 1988

[30] Foreign Application Priority Data

Jul. 4, 1987 [DE] Fed. Rep. of Germany ..... 3722163

[51] Int. Cl.[4] ..... C25G 1/00

[52] U.S. Cl. ..... 204/63

[58] Field of Search ..... 204/63

[56] References Cited

U.S. PATENT DOCUMENTS 3,235,474 2/1966 Tompkins et al. ..... 204/63

*Primary Examiner*—R. L. Andrews

*Attorney, Agent, or Firm*—Foley & Lardner, Schwartz, Jeffery, Schwaab, Mack, Blumenthal & Evans

[57] ABSTRACT

A method for producing $NF_3$ by fused salt electrolysis of electrolytes containing hydrofluoric acid salts of ammonia and of hydrazine and electrolyte mixtures for use therein.

19 Claims, No Drawings

METHOD OF PRODUCING $NF_3$

BACKGROUND OF THE INVENTION

The present invention relates to a method for producing $NF_3$ by fused salt electrolysis of an electrolyte mixture which contains hydrofluoric acid salts of ammonia.

In industry $NF_3$ has found use, inter alia, as a filler gas for flash bulbs, as a fluorination agent, as an oxidizing agent in rocket drives and as a plasma etching gas.

Compared with several other production methods, in practice, fused salt electrolysis of adducts of the type $NH_4F.nHF$ has proved suitable to be carried out on a commercial scale. According to O. Glemser, J. Schroeder and J. Knaak, *Chem. Ber.*, 99, pages 371 to 374 (1966), a good $NF_3$ yield (23–32%) can be expected if the number n is between 1.2 and 1.8 and the fused salt electrolysis is carried out at approximately 130° C. However, this is not accomplished without difficulties, as at such temperatures $NH_4F$ released by sublimation has to be collected in a separate separator in order to prevent accidents due to blocking of the gas outlet pipes. Furthermore, with this method partially fluorinated amines are evolved, which tend to decompose explosively.

SUMMARY OF THE INVENTION

It is the object of the present invention to provide a method by which the technical problems of carrying out the previously known method of producing $NF_3$ can be overcome.

This and other objects are achieved by providing a method of producing $NF_3$ comprising the steps of subjecting an electrolyte mixture containing at least one salt of ammonia with hydrofluoric acid and at least one salt of hydrazine with hydrofluoric acid to fused salt electrolysis, and collecting the resulting $NF_3$-containing gas.

According to another aspect of the invention, the objects thereof are achieved by providing a composition of matter suitable for use as an electrolysis mixture comprising an admixture of at least one salt of ammonia with hydrofluoric acid and at least one salt of hydrazine with hydrofluoric acid.

DETAILED DESCRIPTION OF PREFERRED EMBODIMENTS

The method according to the invention for producing $NF_3$ by fused salt electrolysis using salts of ammonia with hydrofluoric acid is characterized in that an electrolyte mixture which contains salts of ammonia with hydrofluoric acid and salts of hydrazine with hydrofluoric acid is subjected to fused salt electrolysis. The weight ratio of the salts of ammonia and of hydrazine is 9:1 to 1:9, preferably 8:2 to 3:7, particularly preferably 7:3.

Suitable salts of ammonia and hydrofluoric acid include those corresponding to the formula $NH_4F.nHF$ in which n equals from 1 to 2.5. Preferably n equals from 1 to 1.8, and particularly preferably n is equal to 1.

In addition to the aforementioned $NH_4F.nHF$ salts, the fused salt electrolyte mixtures used in the method according to the invention contain salts of hydrazine with hydrofluoric acid as an additional constituent. The fused salt electrolyte mixtures used in the method according to the invention advantageously contain the hydrazine in the form of compounds corresponding to the general formula $N_2H_4.xHF$ wherein x equals from 1 to 2. Preferably x is equal to 2.

The fused salt electrolyte mixtures may optionally also contain additional constituents such as urea, pyridine, KF, KF.HF, hydrofluoric acid, etc.

In a particularly preferred embodiment of the method of the invention, the salt of ammonia is present in the form of $NH_4F.HF$, and the salt of hydrazine in the form of $N_2H_4.2HF$.

The invention also comprises the electrolyte mixtures used in the method according to the invention. These mixtures according to the invention contain hydrofluoric acid salts of ammonia and of hydrazine, and optionally additional constituents such as urea, pyridine, KF, KF.HF, hydrofluoric acid, etc. Hydrofluoric acid salts of ammonia are preferably understood to be compounds of the type $NH_4F.nHF$ wherein n equals from 1 to 2.5, preferably n equals from 1 to 1.8, and particularly preferably n equals 1. The hydrofluoric acid salts of hydrazine are preferably compounds of the type $N_2H_4.xHF$ wherein x equals from 1 to 2, and preferably x equals 2. In a preferred embodiment the mixtures according to the invention contain from 10 to 90% by weight $NH_4F.HF$ and from 90 to 10 wt. % $N_2H_4.2HF$. In accordance with a particularly preferred embodiment of the invention the mixtures include from about 50 to about 80 wt. % $NH_4F.HF$ and from about 50 to about 20 wt. % $N_2H_4.2HF$. Especially preferred are mixtures comprising about 70 wt. % $NH_4F.HF$ and about 30 wt. % of $N_2H_4.2HF$.

The simplest method for producing the mixtures according to the invention comprises mechanically mixing the salts of ammonia, preferably $NH_4F.HF$, and of hydrazine, preferably $N_2H_4.2HF$, and optionally further constituents, for example in a ball mill.

The fused salt electrolysis in the method according to the invention can be carried out in a known manner. Apparatus without separation of the electrode chambers can be used. An example of such an apparatus is found in the previously mentioned publication of O. Glemser et al. Also apparatus with separate removal of the electrolysis gases, as described by J. Massonne, *Chem. Ing. Tech.* 12, pages 95 to 700 (1969) can be used. In such an apparatus the crude $NF_3$-containing gas which is produced is essentially hydrogen-free. Carbon electrodes or metal electrodes, preferably nickel electrodes, may be used as electrodes. The electrode potential is set in the range from 2 to 12 volts, preferably in the range from 5.0 to 6.5 volts, and particularly preferably at about 6 volts. The electrolyte temperature is between 60° C. and 150° C., preferably between 110° and 130° C., and particularly at about 118° C.

The method according to the invention for producing $NF_3$ can be carried out batchwise or continuously. In continuous production the required amount of electrolyte corresponding to the amount consumed in producing the desired composition is introduced continuously into the electrolysis cell, for example by means of an endless screw, and the $NF_3$ gas which forms is continuously withdrawn.

The crude $NF_3$-containing product gas may be purified in a known manner, for example by passing it over KF to remove HF, passing it over oxidizing agents such as manganese dioxide to remove any amine fluorides contained therein, and pumping off $N_2$ and $O_2$ after condensing the $NF_3$. For technical purification, a suitable procedure is to pass the crude gas through a tower filled with NaCl or $NaCl/CaCl_2$ and subsequently wash the gas with aqueous alkali. After drying, the gas may optionally be further purified depending on the purpose for which it is to be used.

The method of the invention, which comprises electrolysis of the mixtures of the invention, is characterized by several surprising advantages:

- The composition of the fused salt electrolyte mixture does not change noticeably during electrolysis; during electrolysis the limiting conditions (electrolyte temperature, potential, current strength) and the composition of the crude gases formed as an electrolysis product remain basically constant, which simplifies industrial production, especially on a large scale.
- The electrolysis can be carried out at a lower temperature than is usual with the known method; the operating life of the electrolysis cells is correspondingly increased.
- When using the electrolyte mixture according to the invention, especially at the lower electrolyte temperature of the method of the invention, the tendency for $NH_4F$ sublimation to occur is greatly decreased.
- The crude $NF_3$-containing gas which is formed contains fewer by-products.

The invention will be explained in further detail in the following non-limiting illustrative examples.

EXAMPLE 1

Production of Mixtures according to the Invention:

Dry $N_2H_4.2HF$ is produced in a known manner by reacting hydrazine hydrate with 40% aqueous hydrofluoric acid in water, removing the water by evaporation, washing the residue with ethanol and drying the washed residue over KOH. Ammonium bifluoride is used in anhydrous form.

The hydrofluoric acid salts of ammonia and hydrazine obtained in this way are intimately mixed, for example in a ball mill, optionally with the addition of further constituents.

Following this procedure, the mixtures according to the invention listed in the following Table 1 were produced.

TABLE 1

Melting Points of Mixtures of $NH_4F.HF$ and $N_2H_4.2HF$

| $NH_4F.HF$ | $N_2H_4.2HF$ | Melting point |
|---|---|---|
| 10 wt. % | 90 wt. % | 134° C. |
| 20 wt. % | 80 wt. % | 132° C. |
| 30 wt. % | 70 wt. % | 129° C. |
| 50 wt. % | 50 wt. % | 123° C. |
| 70 wt. % | 30 wt. % | 118° C. |
| 80 wt. % | 20 wt. % | 116° C. |
| 90 wt. % | 10 wt. % | 122° C. |

EXAMPLE 2

Production of $NF_3$ according to Method of Invention:

A mixture of 70 wt. % $NH_4F.HF$ and 30 wt. % $N_2H_4.2$ HF having a melting point of 118° C. was heated to approximately 118° C. in an electrolysis cell with nonseparated electrode chambers and a nickel electrode and electrolyzed after a short rinse of the electrode chambers with $N_2$. The electrode potential was set at 6 volts, and the current strength after equilibrium operation had been attained was 12 amperes. First the decomposition of moisture in the electrolyte took place, then the formation of $NF_3$. $NF_3$-containing crude gas was withdrawn from the electrolysis cell.

The proportion of $NF_3$ in the crude gas was 18%. After the crude gas was purified by fractional condensation over KF and manganese dioxide, pure gas with an $NF_3$ content of greater than 99% was obtained (analysis by GC). The current yield was 55% of the theoretical, relative to a consumption of 6 Faraday per mole of $NF_3$.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with respect the the appended claims and equivalents.

What is claimed is:

1. A method of producing $NF_3$ comprising the steps of subjecting an electrolyte mixture which contains at least one salt of ammonia with hydrofluoric acid and at least one salt of hydrazine with hydrofluoric acid to fused salt electrolysis, and collecting the resulting $NF_3$-containing gas.

2. A method according to claim 1, wherein the weight ratio of ammonia salt to hydrazine salt is from 9:1 to 1:9.

3. A method according to claim 2, wherein the weight ratio of ammonia salt to hydrazine salt is from 8:2 to 3:7.

4. A method according to claim 3, wherein the weight ratio of ammonia salt to hydrazine salt is about 7:3.

5. A method according to claim 1, wherein said salt of ammonia with hydrofluoric acid corresponds to the formula $NH_4F.nHF$ wherein n equals from 1 to 2.5.

6. A method according to claim 5, wherein n equals from 1 to 1.8.

7. A method according to claim 6, wherein n is about 1.

8. A method according to claim 1, wherein said salt of hydrazine with hydrofluoric acid corresponds to the formula $N_2H_4.xHF$ wherein x equals from 1 to 2.

9. A method according to claim 8, wherein x is about 2.

10. A method according to claim 1, wherein said fused salt electrolysis is carried out at an electrolyte temperature from about 60° to about 150° C. and at an electrode potential in the range from about 2 to about 12 volts.

11. A composition of matter comprising an admixture of from about 10 to about 90 wt. % of a hydrofluoric acid salt of ammonia and from about 90 to about 10 wt. % of a hydrofluoric acid salt of hydrazine.

12. A composition of matter according to claim 11, wherein said hydrofluoric acid salt of ammonia corresponds to the formula $NH_4F.nHF$ wherein n equals from 1 to 2.5.

13. A composition of matter according to claim 12, wherein n equals from 1 to 1.8.

14. A composition of matter according to claim 13, wherein n equals about 1.

15. A composition of matter according to claim 11, wherein said hydrofluoric acid salt of hydrazine corresponds to the formula $N_2H_4.xHF$ wherein x is from about 1 to about 2.

16. A composition of matter according to claim 15, wherein x is about 2.

17. A composition of matter according to claim 11, comprising from about 10 to about 90 wt. % $NH_4F.HF$ and from about 90 to about 10 wt. % $N_2H_4.2HF$.

18. A composition of matter according to claim 17, comprising from about 50 to about 80 wt. % $NH_4F.HF$ and about 50 to about 20 wt. % $N_2H_4.2HF$.

19. A composition of matter according to claim 18, comprising about 70 wt. % $NH_4F.HF$ and about 30 wt. % $N_2H_4.2HF$.

* * * * *